United States Patent [19]

Grotto

[11] Patent Number: 4,672,724

[45] Date of Patent: Jun. 16, 1987

[54] LOCK FOR ORNAMENTAL JEWELRY CHAIN

[75] Inventor: Ferdinando Grotto, Bassano del Grappa, Italy

[73] Assignee: Oroamerica, Inc., Burbank, Calif.

[21] Appl. No.: 865,370

[22] Filed: May 21, 1986

[51] Int. Cl.[4] ..... A44B 11/25

[52] U.S. Cl. ..... 24/616; 24/573

[58] Field of Search ..... 24/573, 574, 616, 615, 24/614

[56] References Cited

U.S. PATENT DOCUMENTS

| | | | |
|---|---|---|---|
| 848,972 | 4/1907 | Costello | 24/616 |
| 1,232,733 | 7/1917 | Swedlund | 24/616 X |
| 2,266,074 | 12/1941 | Rauer | 24/616 |
| 4,170,809 | 10/1979 | Geldwerth et al. | 24/616 |
| 4,426,854 | 1/1984 | Geldwerth et al. | 24/616 X |
| 4,520,537 | 6/1985 | Valikov | 24/616 |
| 4,559,679 | 12/1985 | Downey | 24/615 |

*Primary Examiner*—Philip C. Kannan

*Attorney, Agent, or Firm*—Drucker & Sommers

[57] ABSTRACT

A simplified springless fastener includes a housing or box element onto which a first fastener element, having a clasp, is welded. The first fastener element has a hook-like extension extending into the housing. Insertable within the housing element is a resilient tang, having a second fastener element, which will engage, in locking fashion, the hook extension of the first fastener element located within the rectangular housing. The fastener elements may be unfastened simply by depressing one leg of the resilient tang. Thus structure is simple and economical to produce.

5 Claims, 4 Drawing Figures

Fig. 1
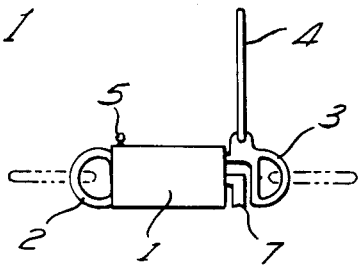
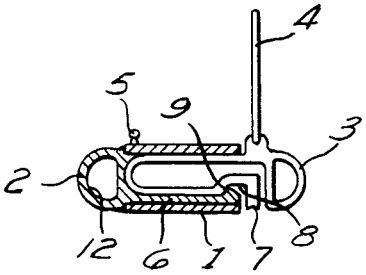
Fig. 2
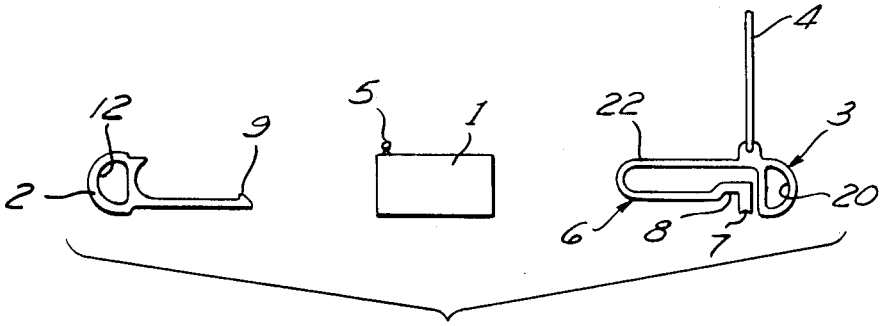
Fig. 3
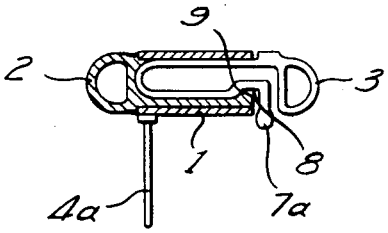
Fig. 4

LOCK FOR ORNAMENTAL JEWELRY CHAIN

DESCRIPTION OF BACKGROUND

The present invention's purpose is to create a "click" fastener for ornamental chains. Its innovative characteristic is essentially, its simple construction, and the ease with which it can be assembled, making its repetitive production economical and fast.

For a long time, fastening units for ornamental chains and necklaces have been known; these are generally of a "box"-like type with an incorporated click mechanism that has a movable fastening element made up by a resilient tang which provides a means for engagement and disengagement. The present types of fasteners, however, require a considerable manufacturing cost due to the various manufacturing steps used by a very complex automatic cutter that produces a very rigid piece.

SUMMARY OF THE INVENTION

The type of fastening of this invention is created with very simply shaped parts making it economically convenient. At the same time, the fastening is equally secure. The fastener includes a box-like, hollow housing element into which a first hook fastener element, having an affixed clasp, is inserted and welded. The entire housing unit, so formed, is hooked onto one of the rings at the chain's extremity, by means of the welded clasp.

The second fastener element is a generally U-shaped tang element, having a resilient leg portion and a welded-on clasp at one end of the tang element. The tang element is insertable within the housing element and is held in a fixed position within the housing element by means of a notch that mates with the hook of the first fastener element or projection. In this fixed position, the welded-on clasp of the tang element projects from the housing element, and is fastened to the extremity ring of a chain.

A simple projection protrudes from the resilient tang element, when inserted within the housing element. When pressure is exerted on the tang projection, as by a fingernail or finger, disengagement of the notch portion of the fastener from the hook portion of the fastener occurs, and complete disengagement takes place by pushing the tang element outwardly from the housing element (after a safety catch is first removed).

In such a way, a secure, effective, and economical click fastener is obtained. Its manufacturing is particularly simple and economical; it can also be entirely made from a precious metal with all the ensuing advantages, and without springs.

BRIEF DESCRIPTION OF THE DRAWINGS

FIG. 1 represents an assembled view, in side elevation, of the fastener of this invention shown in conjunction with the extremity rings of a jewelry chain (shown in dotted line);

FIG. 2 represents a longitudinal cross-section of the invention;

FIG. 3 represents an exploded side elevational view of the three separate elements that comprise the invention; and FIG. 4 a longitudinal cross-sectional view of a second embodiment of this invention.

DETAILED DESCRIPTION OF THE DRAWINGS

As can be seen in FIGS. 1–3, the lock includes a hollow, box-like housing element 1, into which a first fastening element 2 is inserted and then welded. The thusly fixed-in-place male fastening element 2 has an external link or clasp 12 projecting from one end of the fixed fastening element 2, and this link 12 is fixed externally of, and immediately adjacent to, the housing element 1, as best shown in FIGS. 1 and 2.

The first, or fixed, fastening element 2 has a hook or prong 9 formed at one extremity, this hook forming a part of the fastener, as will be described.

The second or moveable element 3 of the fastener of this invention is linked onto the remaining end of the jewelry chain by means of link 20. The moveable fastener element 3 includes a resiliently moveable wire-like U-shaped tang element 6, one end of which is fixedly mounted to the link 20 (see FIGS. 2 and 3 especially) and the other end of which is provided with a notch 8 that is generally complementary to the hook 9 of the fixed fastener element 2. Element 6 is resiliently moveable because its lowermost shaft portion 22 is not fixed at the notch end, and the shaft portion 22 is formed of wire-like material.

Moveable fastener element 3 is slideably moveable within housing element 1 inasmuch as the leg portion 22 thereof is resilient, and may be compressed as it is slid inwardly within housing element 1. Fastening engagement of fastener portions 2 and 3 occurs when the hook 9 of fastener element 2 enters the notch 8 of fastener element 3, and the compression on the leg portion 22 is released. A "click" is heard when hook 9 and notch 8 are engaged, hence the term "click fastener." Disengagement of the fastener elements 2 and 3 occurs when upward pressure is exerted on projection 7 as viewed in FIGS. 1–3), thereby unhooking hook 9 from notch 8 and permitting the movement of fastener element 3 to the right, again as viewed in FIGS. 1–3.

A conventional safety catch feature may be provided comprising a safety link 4, pivotally attached to fastener element 3, and a complementary knob or post 5 fixed to the housing unit 1. Safety link 4 may be readily engageable with, and disengageable from, the post 5 by manual pressure, in a conventional manner.

Referring to FIG. 4, a second embodiment of safety catch is shown wherein the projection **7*a*, for depressing and disengaging the tang 3, also functions as the knob or post of the safety catch. The safety link of the safety catch is designated by numeral 4*a* and is pivotally mounted to the housing 1 rather than the tang 3, as in the FIGS. 1–3 embodiment. In this way, the knob or post 5 of the FIGS. 1–3** embodiment may be eliminated.

It is to be noted that all the elements making up the unit can easily be manufactured from precious metals due to the fact that the unit does not contain a spring.

The fastener's advantages are evident if compared to the fastening elements that have been used up to know, particularly those used by jewel-makers. Above all, the end product's simple construction, which does not require expensive tooling, should be noted.

I claim:

1. A fastener for jewelry chain which comprises:

a hollow housing element including first and second opposed ends;

a first fastener element comprising a first clasp and an elongated element extending therefrom having a hook portion thereon, said first fastener element being adapted to be fixed externally to the first end of said housing element so that said first clasp is affixed to a first end of, and external of, said housing element, and said elongated element and hook portion is affixed internally within said housing element;

a second moveable fastener element comprising a second clasp and a U-shaped tang including first and second ends thereof extending therefrom, said tang having a resilient portion thereof containing a notch complementary to said hook portion of said first fastener element whereby:

(a) fastening of said fixed and moveable fastener elements takes place when said resilient U-shaped tang is compressed, inserted within said housing element until said hook portion and notch are in alignment, and then decompressed, to thereby cause insertion of said hook portion into said notch and fastening of said fixed and moveable fastener elements; and (b) unfastening of said fixed and said moveable fastener elements takes place when said resilient U-shaped tang is again compressed, and said moveable fastener element is moved outwardly from said fixed fastener element; and means for externally fixing the first fastener element to the first end of the hollow housing element.

2. The fastener of claim 1 wherein said tang is provided with a tang projection depending from the first end thereof for enabling the exertion of manual pressure on said tang projection, and compression of said tang.

3. The fastener of claim 1 characterized by a safety catch comprising:

a pin affixed to, and extending from said housing element, and a safety link pivotally attached to said moveable fastener element for engagement and disengagement with said pin.

4. The fastener of claim 2 characterized by a safety catch comprising:

a safety link pivotally attached tb said housing element, said link being engageable with, and disengageable from, said tang depending projection.

5. A fastener as in claim 1, in which the fixing means comprise means for externally welding the first fastener element to the hollow housing element.

* * * * *